US006102415A

United States Patent [19]

Stewardson

[11] Patent Number: 6,102,415

[45] Date of Patent: Aug. 15, 2000

[54] INHERENTLY STABLE RIDEABLE PLATFORM

[76] Inventor: John Edward Stewardson, 157 Waxham Mansfield Road, Gospel Oak London NW3 2JL, United Kingdom

[21] Appl. No.: 09/008,082

[22] Filed: Jan. 16, 1998

[51] Int. Cl.[7] ..... B62M 1/00; A63C 1/00

[52] U.S. Cl. ..... 280/87.042; 280/11.27

[58] Field of Search ..... 280/87.042, 87.041, 280/87.03, 87.021, 87.043, 11.27, 11.28, 11.22, 842

[56] References Cited

U.S. PATENT DOCUMENTS

| | | | |
|---|---|---|---|
| 887,812 | 5/1908 | Johnson | 280/87.042 |
| 4,194,752 | 3/1980 | Tilch et al. | 280/87.042 |
| 4,398,735 | 8/1983 | Evans et al. | 280/87.042 |
| 5,052,702 | 10/1991 | Chan | 280/87.042 |
| 5,853,182 | 12/1998 | Finkle | 280/87.042 |

*Primary Examiner*—Lanna Mai
*Assistant Examiner*—Jeff Restifo

[57] ABSTRACT

The Inherently Stable Riding Platform is a platform supported by a suspension system including a pair of two wheeled caster action bogies, the rear bogie mounted to the platform by two ball-joints forming a single axis pivotal discipline and the front bogie mounted to the platform by five ball-joints; four joints arranged in pairs to form two separate elongated restraining linkages and a single supporting ball-joint; the five together forming a multi-axis pivotal discipline. The whole arrangement is inherently stable and steerable by positionings of the rider's body. Energy for propulsion is harnessed because a turning movement of the bogies results in the platform rising due to the pivotal discipline of the suspension geometry. Conversely, straightening of the bogies releases the energy.

1 Claim, 2 Drawing Sheets

INHERENTLY STABLE RIDEABLE PLATFORM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to Skateboard Art.

2. Description of the Related Art

Skateboarding began in the 1950's when American surfers practised on land with boards supported by trucks taken from roller skates. There have been modifications since but those arrangements remain the basic convention of skateboarding with trucks retaining design features previously developed to solve problems peculiar to propulsion from wheels attached to each foot.

A skateboard is, in effect, an enlarged roller skate and, as a skate, made rideable by rubber or plastic bushes arranged within truck assemblies to absorb destabilising moments arising from their pivoting geometry. These bushes are essential in skates for holding their trucks firmly about a central position thereby giving a considerable resistance to lateral tilting of the foot platform. Consequently, as a skateboard is controlled by the lateral tilting of its foot platform, responsiveness and manoeuvrability are compromised; stiffness in the trucks pivoting capabilities limiting a rider's freedom to manoeuvre.

Despite the evident drawbacks and attempts to minimise these effects, skate truck configurations continue to dominate in skateboard design, leaving the conflict between a need for stability and a freedom to manoeuvre unresolved.

This invention deals directly with that problem.

BRIEF SUMMARY OF THE INVENTION

The invention is of a suspension system to support a steerable platform, hereafter referred to as a board in which the roller skate style of wheel support, with attendant bushings, is superseded by a design specific in providing an inherent stability; allowing a freedom to manoeuvre and gain forward motion, not possible within past and current skateboarding art to which this vehicle relates.

The system supports four wheels attaching to a board in pairs. At the rear of the board, an assembly, hereafter referred to as a bogie, comprising a pair of wheels attached to a pair of legs extending rearward from a common base held by two ball-joints, together forming an inclined pivot attaching the bogie to the board to produce a castering effect, when the board is in forward motion, governing the boards ability to tilt. A shift in the rider's position produces a progression in that governing effect by whatever amount is required to tilt the board in manoeuvring. A similar bogie is connected to the front of the board by a five ball-joint arrangement the geometry of which, while producing effects similar to that of the rear bogie, raises the board by compelling the rear of the bogie with its extended arms, to progressively depress as it turns away from a central position. The rider's weight, when central, prevents the board from rising thereby preventing the bogie turning. A shift in the rider's position allows the board to rise and thereby tilt by whatever amount required in manoeuvring. Energy from the rider's movements in raising and lowering the board is released in forward motion.

DETAILED DESCRIPTION OF THE INVENTION

Figure 1:
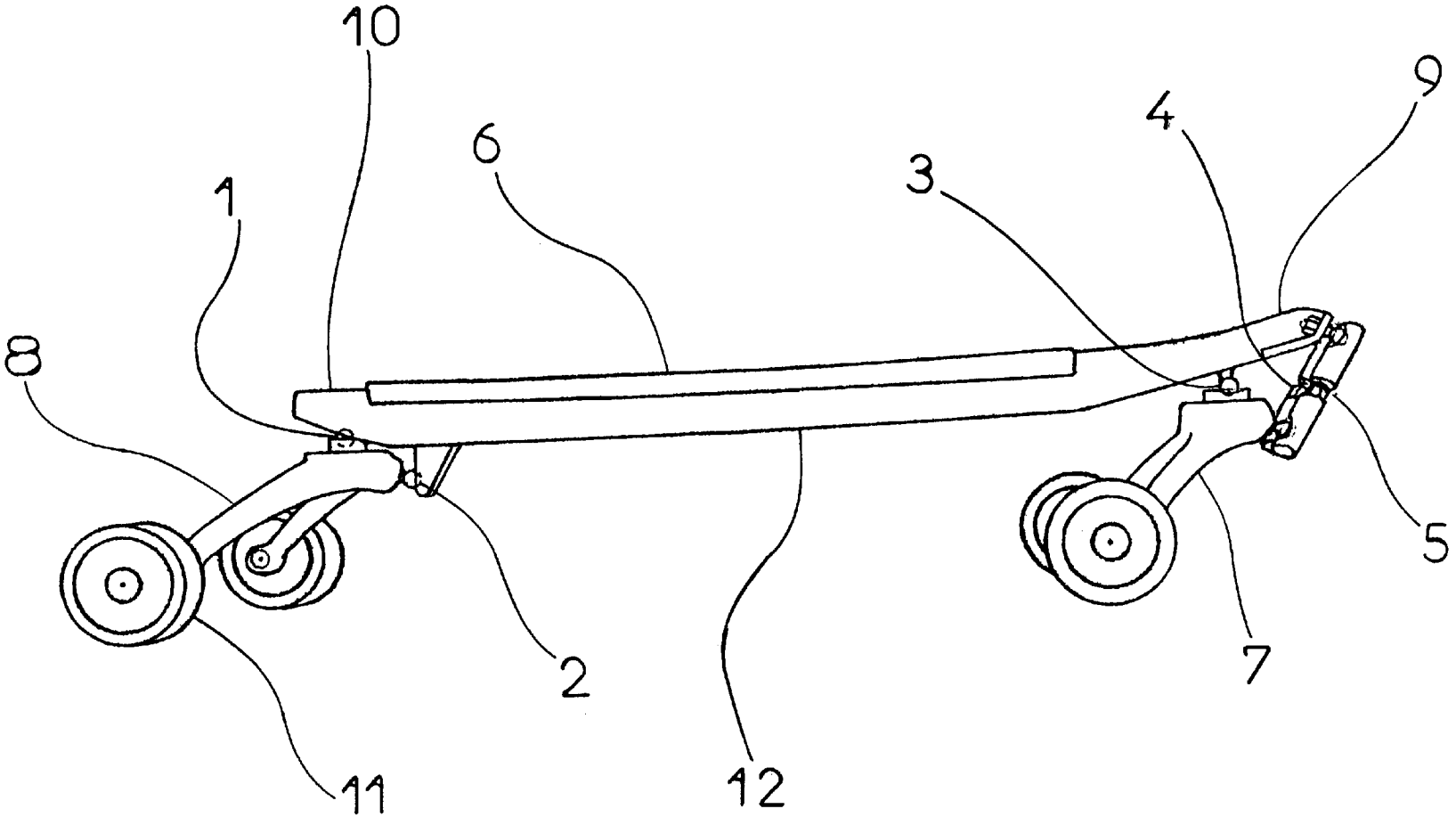
FIG. 1 is a side view, in perspective, of the invention.
Figure 2:
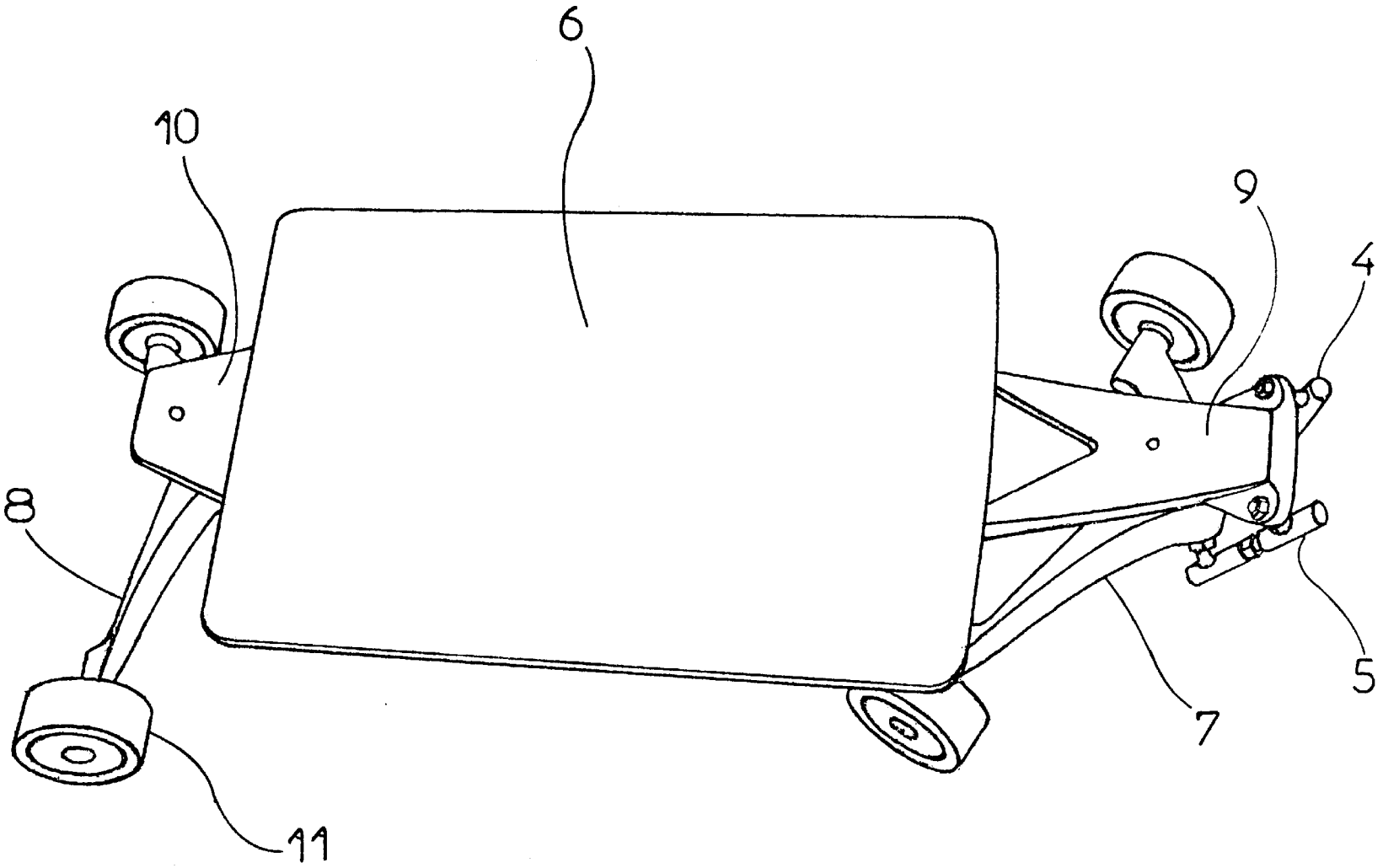
FIG. 2 is a view, in perspective, from above the invention.

Referring now to the drawings; FIG. 1 and FIG. 2, illustrating a vehicle generally constructed within the principles of this invention; they show a riding board 6 supported by a structure comprising a beam 12 with tail section 10 and nose section 9 and a pair of supporting bogies 7 and 8, positioned under opposite ends of this structure. Bogies 7 and 8 each consist of a pair of legs extended rearward from a base section; at the end of each leg is mounted a wheel 11. On top of the base section is an attachment point to accommodate one end of a ball-joint as for joints 1 and 3 on bogies 7 and 8 respectively. On the front edge of the base section of the front bogie 7 symmetrically set in horizontal alignment are two attachment points for connection of the projecting ends of ball-joints forming the bottom ends of pods 5 and 4. Centred on the front edge of the base section of the rear bogie 8, is an attachment point to accommodate one end of ball-joint 2.

Ball-joints 1 and 2 attached to the rear bogie 8 as previously indicated and the opposite ends of those joints attaching to the tail section as indicated in FIG. 1 result in an angled single axis, pivotal discipline between the rear bogie 8 and the support structure. Ball-joint 3 and the projecting ends of the ball joints forming the bottom ends of pods 4 and 5 attached to the bogie as previously indicated and the opposite end of ball-joint 3 and the projecting ends of ball-joints forming the top ends of pods 4 and 5 attaching in horizontal alignment to the nose section 9 as indicated in FIGS. 1 and 2 result in a multi-axis pivotal discipline between the front bogie 7 and the support structure.

I claim:

1. A riding platform comprising:

a board with projecting nose and tail sections for supporting a rider, a rear bogie mounted under said tail section of said board, said rear bogie having a pair of rear wheels attached by a pair of rear legs diverging and extending downwardly and rearwardly from a first support unit, said first support unit having a top side which is mounted to said tail section by means of a first ball-joint, located on a rear portion of said first support unit, and a second ball-joint, located on a front portion of said first support unit, wherein said first and second ball-joints form a single pivotal axis between said rear bogie and said board, a front bogie mounted under said nose section of said board, said front bogie having a pair of front wheels attached by a pair of front legs diverging and extending downwardly and rearwardly from a second support unit, said second support unit having a top side which is mounted to said nose section by means of a third ball-joint, located on a rear portion of said second support unit, and a pair of elongated double ball-joint link members, said link members located on a front portion of said second support unit, wherein said elongated double ball-joint link members each comprise a lower ball-joint connection, which connects the lower end of the link member to the second support unit, and an upper ball-joint connection which connects the upper end of the link member to the nose portion of said board, wherein said double ball-joint link member and said third ball-joint form a multi-axis pivotal discipline between said front bogie and said board.

* * * * *